US008408934B2

(12) United States Patent
Sakakura et al.

(10) Patent No.: US 8,408,934 B2
(45) Date of Patent: Apr. 2, 2013

(54) CONNECTOR

(75) Inventors: Kouji Sakakura, Yokkaichi (JP); Daisuke Nakagawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 158 days.

(21) Appl. No.: 13/021,836

(22) Filed: Feb. 7, 2011

(65) Prior Publication Data

US 2011/0195596 A1 Aug. 11, 2011

(30) Foreign Application Priority Data

Feb. 8, 2010 (JP) ..... 2010-025409

(51) Int. Cl.
*H01R 4/38* (2006.01)

(52) U.S. Cl. ..... 439/384; 439/607.41; 439/472

(58) Field of Classification Search ..... 439/382–385, 439/449, 470, 472, 564, 607.28, 607.41, 439/939

See application file for complete search history.

(56) References Cited

U.S. PATENT DOCUMENTS

| | | | | |
|---|---|---|---|---|
| 5,997,349 | A | 12/1999 | Yoshioka | |
| 6,887,105 | B2 * | 5/2005 | Knighten et al. | 439/607.24 |
| 7,275,960 | B2 * | 10/2007 | Fukushima et al. | 439/607.15 |
| 7,381,072 | B2 * | 6/2008 | Nagano | 439/248 |

* cited by examiner

*Primary Examiner* — Khiem Nguyen

(74) *Attorney, Agent, or Firm* — Gerald E. Hespos; Michael J. Porco; Matthew T. Hespos

(57) ABSTRACT

A connector is provided for improving connection reliability between terminal fittings by preventing wires from shaking to prevent sliding movements of the terminal fittings. The connector includes a metallic shield shell (10) to be mounted at ends of a plurality of wires (50). The shield shell (10) includes a mounting portion (11) for fixing the connector to a case of a device, and the mounting portion (11) includes a wire fixing portion (20) for holding and fixing the plurality of wires (50) on a surface thereof at a draw-out side of the wires (50).

9 Claims, 8 Drawing Sheets

CONNECTOR

BACKGROUND OF THE INVENTION

1. Field of the Invention

The invention relates to a connector to be mounted at ends of wires.

2. Description of the Related Art

U.S. Pat. No. 5,997,349 discloses a connector to be mounted at ends of wires. The connector has a housing formed with cavities. Terminal fittings are crimped and connected at the leading ends of wires and are inserted into the cavities of the housing from behind. Front ends of the terminal fittings engage front stops in the cavities to prevent the terminal fittings from being withdrawn forward. Flexible locking lances in the housing engage engaging portions of the terminal fittings to prevent the terminal fittings from being withdrawn reward.

The terminal fittings are mounted as separate parts into the cavities of the housing. Thus, clearances exist between the terminal fittings and the inner walls of the cavities and slight shaking of the terminal fittings in the cavities is unavoidable. A connector in a wiring harness mounted in a vehicle is subject to continuous vibration as the vehicle runs. Thus, the wires vibrate and cause the terminal fittings to shake forward and backward in the cavities even after the connector is connected with a mating connector. This vibration is problematic in that connected parts of mated terminal fittings slide and cause abrasion to reduce connection reliability between the terminal fittings.

The invention was developed in view of the above situation and an object thereof is to improve connection reliability between terminal fittings by preventing wires from shaking and thereby preventing sliding movements of the terminal fittings.

SUMMARY OF THE INVENTION

The invention relates to a connector with a conductive shield shell for at least partly covering an outer surface of the connector and to be mounted at ends of one or more wires. The connector is connected with a device-side connector provided on a device. The shield shell includes a mounting seat extending from an outer surface thereof, and a wire fixing portion for fixing the wires drawn out from the connector. The wire fixing portion is bolted to the mounting seat.

The wire fixing portion preferably is made of synthetic resin.

The wires drawn out from a housing are fixed by the wire fixing portion bolted to the connector itself. Thus, sliding movements of terminal fittings caused by shaking of the wires can be prevented. Further, the wires can be fixed to the wire fixing portion before an assembling operation with the device-side connector. Thus, there is no need to fix the wires after the assembling operation and the number of operation steps during the assembling operation can be reduced.

The wire fixing portion may be capable of collectively sandwiching and fixing a shielding member for collectively covering the wires and/or a protection member for covering the wires and the shielding member. According to such a construction, the wires need not be shielded and fixed individually. A bundle of the wires can be shielded collectively and the wires and the shielding member can be fixed by being covered.

The wires, the shielding member and the protection member may be fixed integrally by a tightening member to prevent these individual parts from shaking and to prevent sliding movements of the terminal fittings.

The wire fixing portion may be formed with at least one wire holding groove bent in a direction intersecting a draw-out direction of the wires from the connector. Thus, shaking of the wires in forward and backward directions is suppressed and the wires are fixed more reliably.

The mounting seat may be formed with at least one bolt insertion hole to bolt the shield shell to a case of the device. Thus, a separate mounting portion is not required for assembling and fixing the connector with and to the device-side connector. Accordingly, there is no increase in the number of parts and costs are reduced.

The wire fixing portion may include at least one wire receiving portion to be bolted to the mounting seat and at least one wire pressing portion made of synthetic resin for fixing the wires by sandwiching the wires in cooperation with the wire receiving portion. Thus, the wires can be fixed reliably by being sandwiched between the wire receiving portion and the wire pressing portion regardless of the presence or absence of the shielding member and the protection member for the wires.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
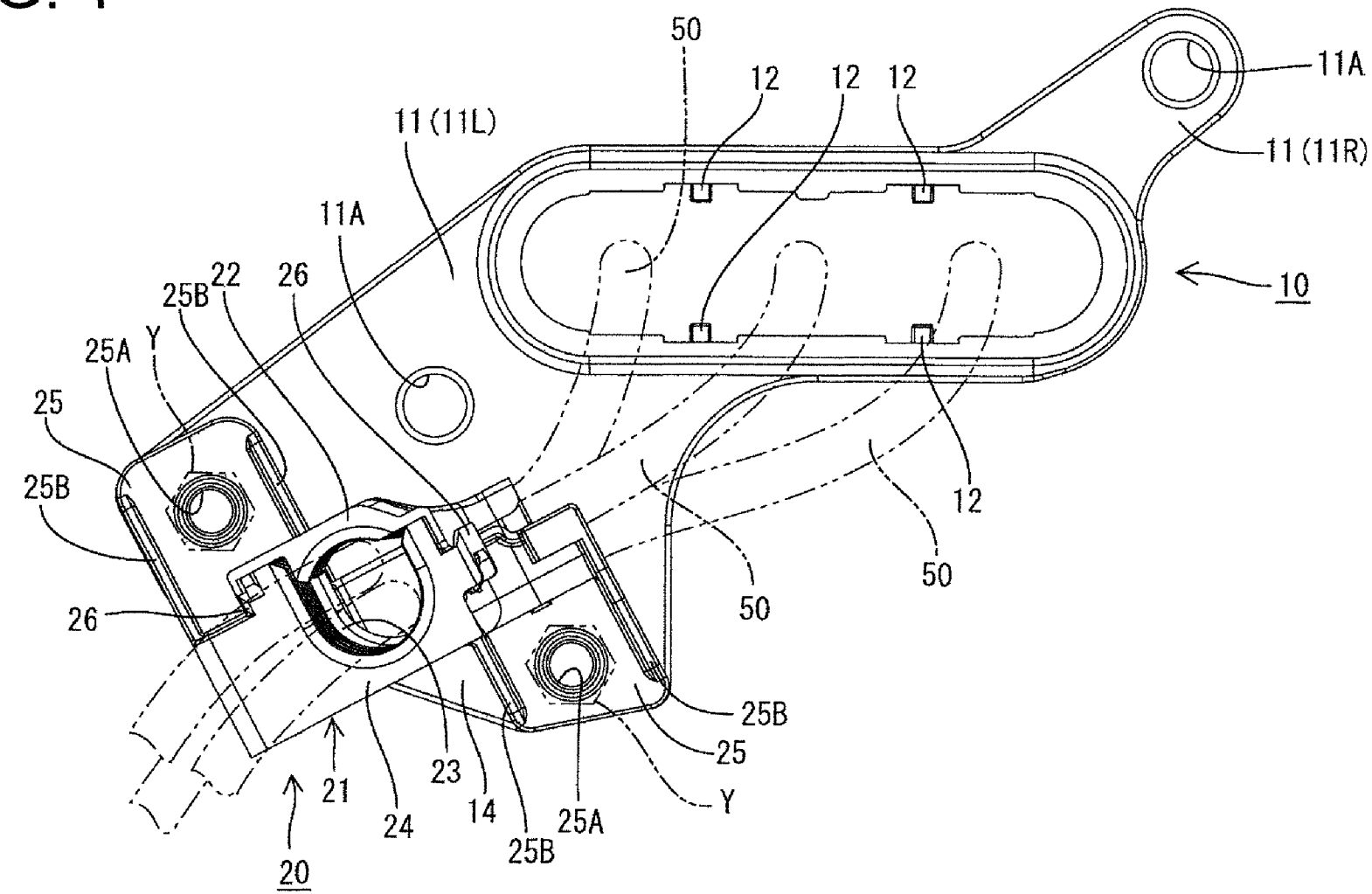
FIG. 1 is a front view showing a state where a wire fixing portion is mounted on a shield shell in one embodiment of the present invention.
Figure 2:
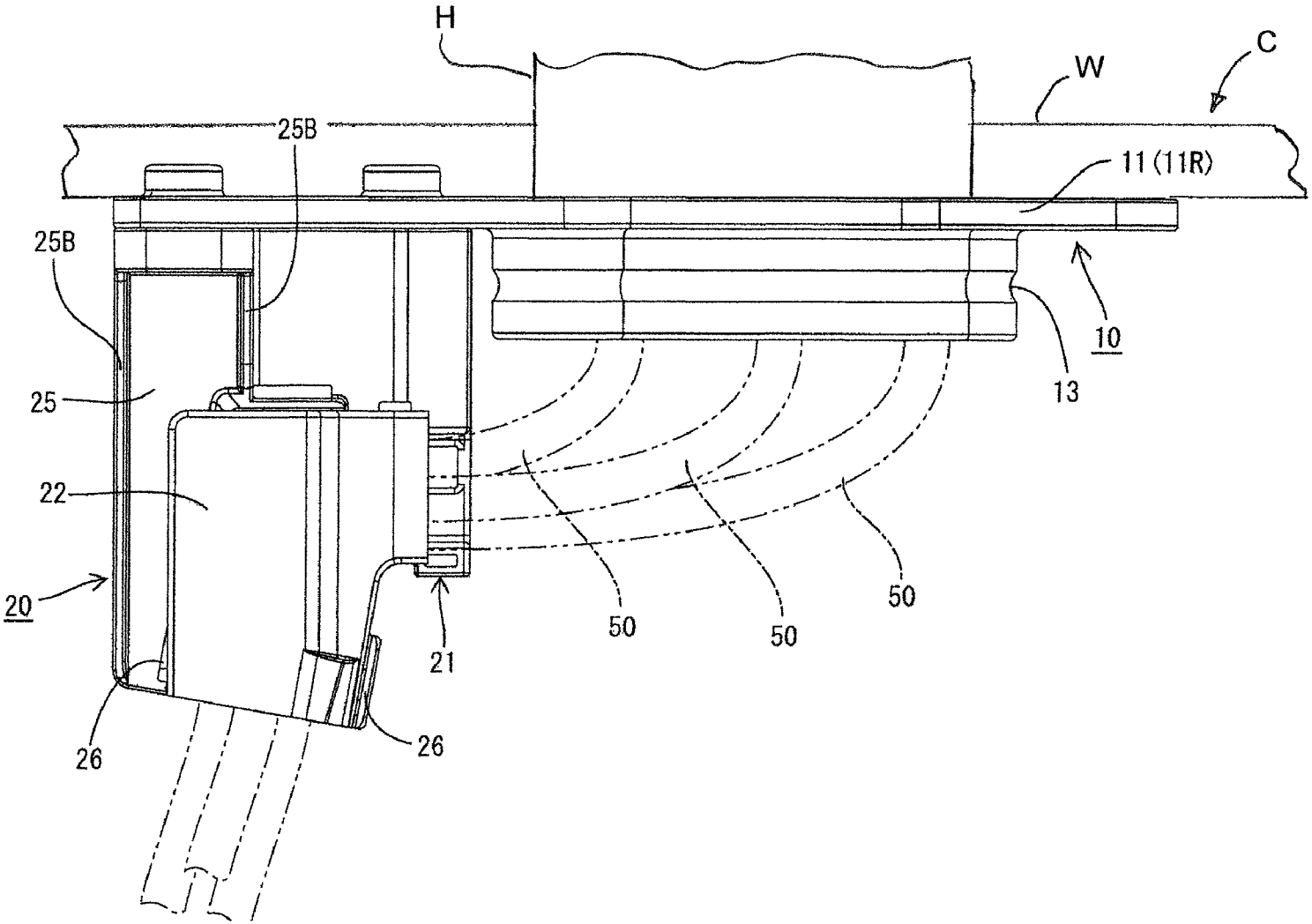
FIG. 2 is a plan view showing the state of FIG. 1.
Figure 3:
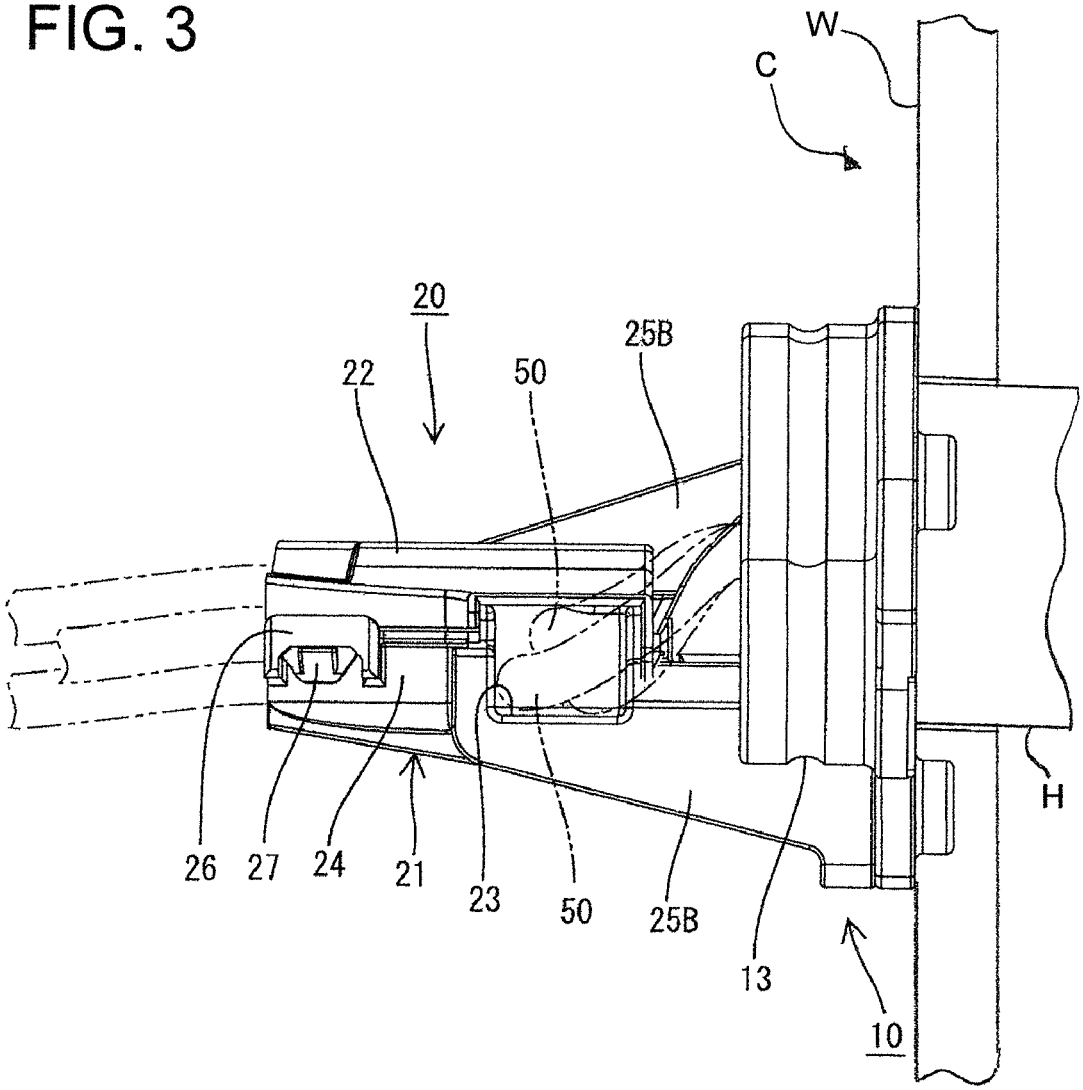
FIG. 3 is a side view showing the state of FIG. 1.
Figure 4:
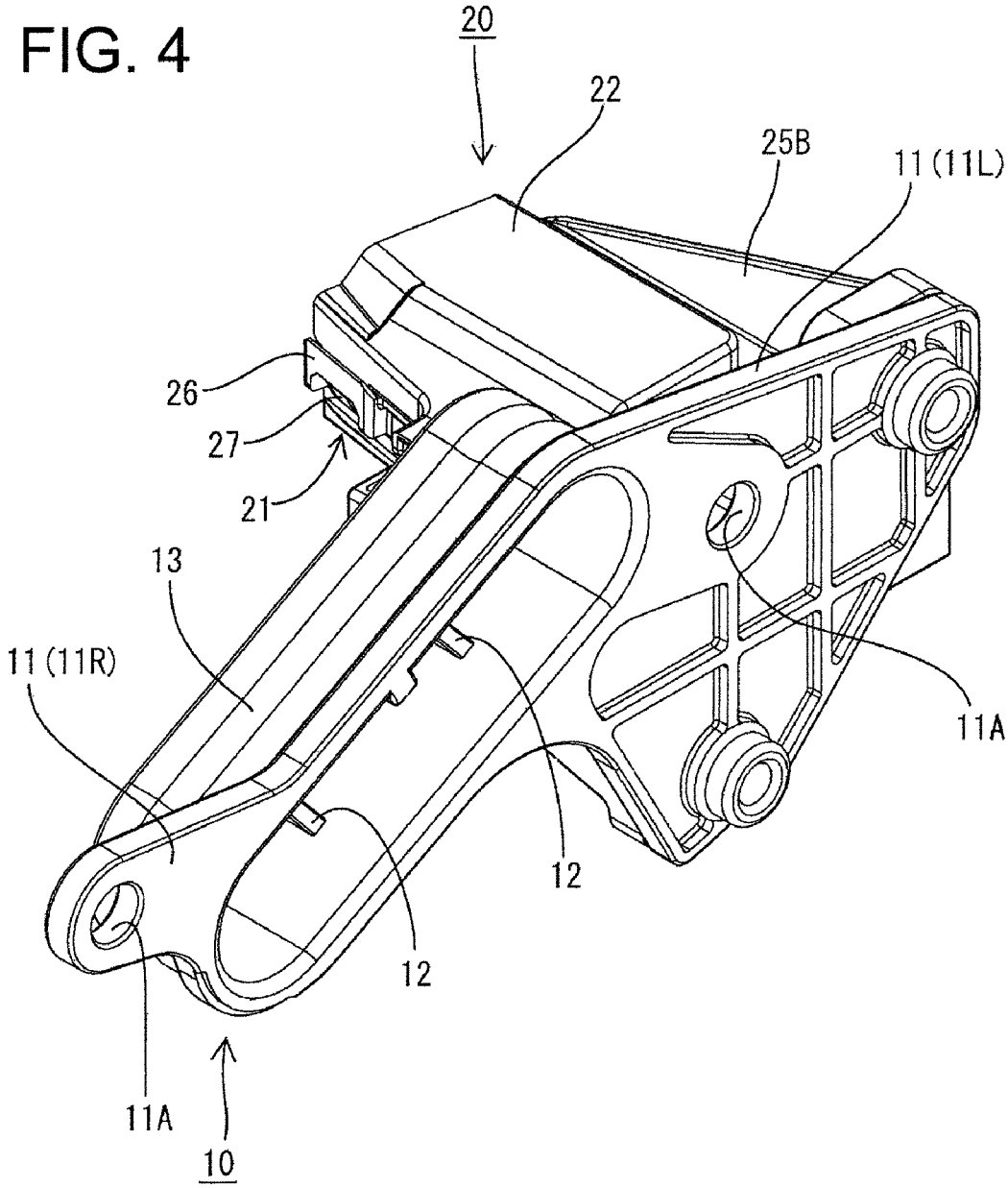
FIG. 4 is a perspective view showing the state of FIG. 1 when viewed from behind.
Figure 5:
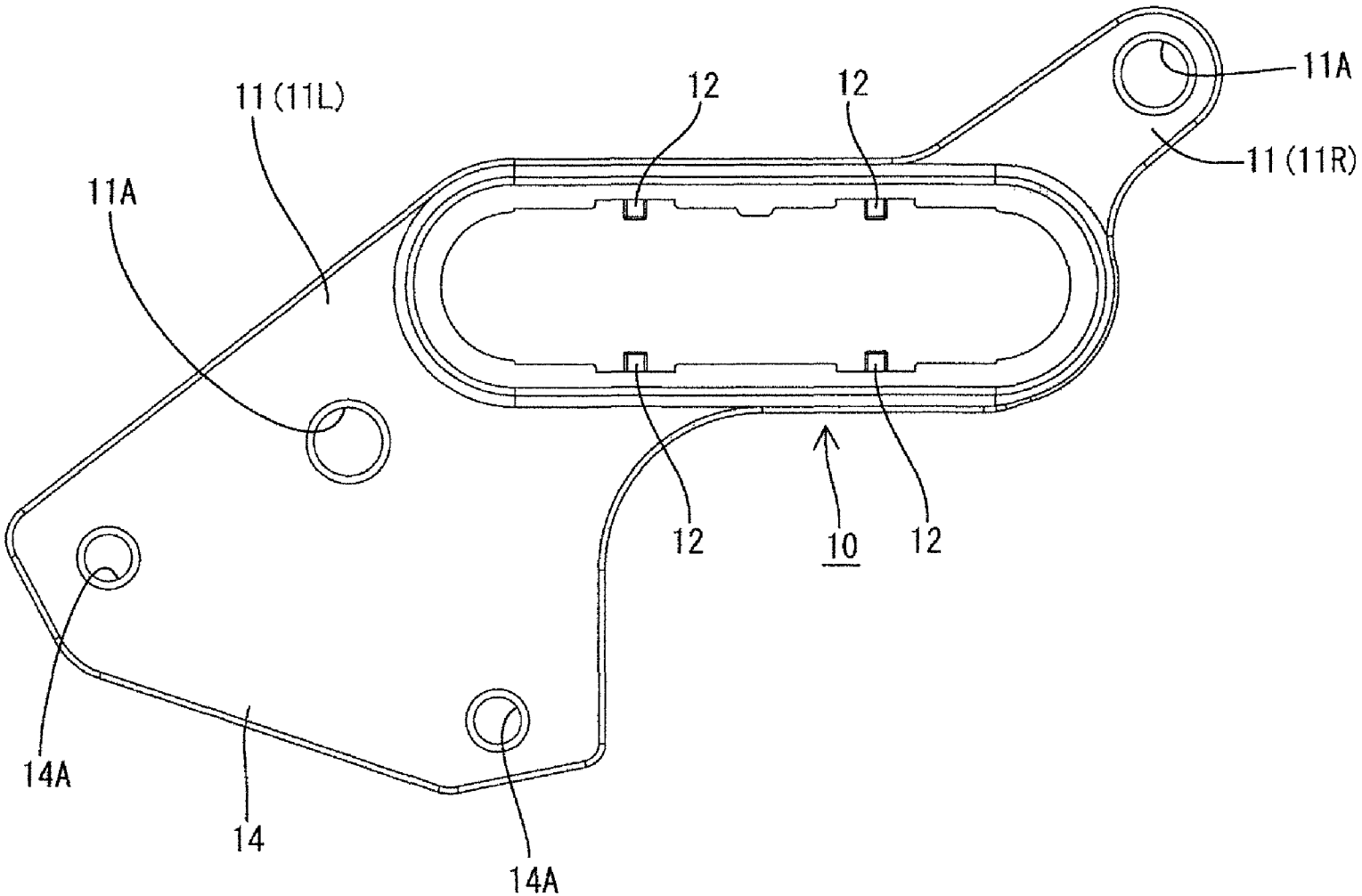
FIG. 5 is a front view of the shield shell showing a state before the wire fixing portion is mounted.

One particular embodiment of the present invention is described with reference to FIGS. 1 to 5.

A connector has a housing H to be mounted at ends of wires 50 and a conductive metallic shield shell 10 at least partly covering the housing H. In the following description, an end to be mounted on a case C of a device and a wire draw-out end are respectively referred to as front and rear ends and vertical and lateral directions are based on those in FIG. 1.

As shown in FIGS. 2 to 5, this shield shell 10 is a short tube with an oblong cross section and has a mounting portion 11 to mount the connector on a wall W of the case C of the device (not shown) at an outer edge of a front side thereof.

Engaging claws 12 are formed at four positions on the inner surface of the shield shell 10 e.g. at upper and lower sides to engage with the unillustrated connector housing inserted therein from the front.

The mounting portion 11 is formed unitary to the shield shell 10 by mounting pieces 11R, 11L extending from an upper right position and a lower left position of the outer edge of the shield shell 10. Bolt insertion holes 11A are formed at the leading end of the upper right mounting piece 11R and at a position of the lower left mounting piece 11L closer to the shield shell 10 than a central part for permitting insertion of bolts for fixing the shield shell 10 to the case of the device (not shown).

The mounting piece 11L at the lower left position is larger than (particularly more than twice as large, e.g. about seven times as large as) the mounting piece 11R at the upper right position, and the leading end thereof is somewhat wider than the base end and extends somewhat down. A mounting seat 14 including bolt fastening holes 15 near two corners is provided at a rear surface of a leading end portion of the mounting piece 11L. A wire fixing portion 20 extends back from the mounting seat 14 and is fixed to the mounting seat 14 by fastening bolts Y.

The wire fixing portion 20 is made e.g. of synthetic resin and includes a wire receiving portion 21 to be fixed to the mounting seat 14 and a wire pressing portion 22 for fixing and sandwiching wires 50 in cooperation with the wire receiving portion 21.

The wire receiving portion 21 includes a receiving main body 24 formed with a wire holding groove 23 for holding the wires 50, and two fixing pieces 25 extending from substantially opposite ends of the receiving main body 24.

The receiving main body 24 is substantially in the form of a somewhat flat box and is arranged so that a longitudinal direction thereof is substantially parallel to an extending direction of the mounting pieces. The wire holding groove 23 is formed in the upper surface of the receiving main body 24 and extends back from an end of the receiving main body 24 at a wire draw-out side. Additionally, the wire holding groove 23 is configured for bending the wires 50 into substantially in L or S shape. Opposite end edges of the wire holding groove 23 are substantially C- or V- or U-shaped with a front opening edge facing laterally and a rear opening edge facing up. Further, locking frames 26 project from the outer surface at the opposite shorter side surfaces of a rear part of the receiving main body 24.

The two fixing pieces 25 are substantially L-shaped plates that extend straight toward the mounting seat 14 from opposite different longitudinal end surfaces of the receiving main body 24 and have bent leading ends. Fastening bolt holes 25A are formed at the bent leading ends of the substantially L-shaped fixing pieces 25 for receiving respective fastening bolts Y. Thus, the wire receiving portion 21 can be fixed to the mounting seat 14 by screwing the fastening bolts Y into respective bolt holes 14A of the mounting seat 14.

The wire pressing portion 22 is a substantially rectangular plate and is mounted on the wire receiving portion 21 to at least partly cover the wire receiving portion 21 from above. A surface of the wire pressing portion 22 that faces the wire receiving portion 21 is recessed somewhat. The wire pressing portion 22 is fixed to the wire receiving portion 21 by inserting engaging pieces 27 on the opposite shorter outer side surfaces of the wire pressing portion 22 into the respective engaging frames 26 on the wire receiving portion 21 and engaging them with the engaging frames 26.

In this way, the wires 50 drawn out from the unillustrated connector housing are prevented from shaking by being arranged along the wire holding groove 23 of the wire receiving portion 21 and being sandwiched between the wire receiving portion 21 and the wire pressing portion 22. Further, since the wire holding groove 23 has a substantially L or S shape so as to intersect with a sliding direction of unillustrated terminal fittings, shaking in forward and backward directions can be suppressed even more.

Figure 6:
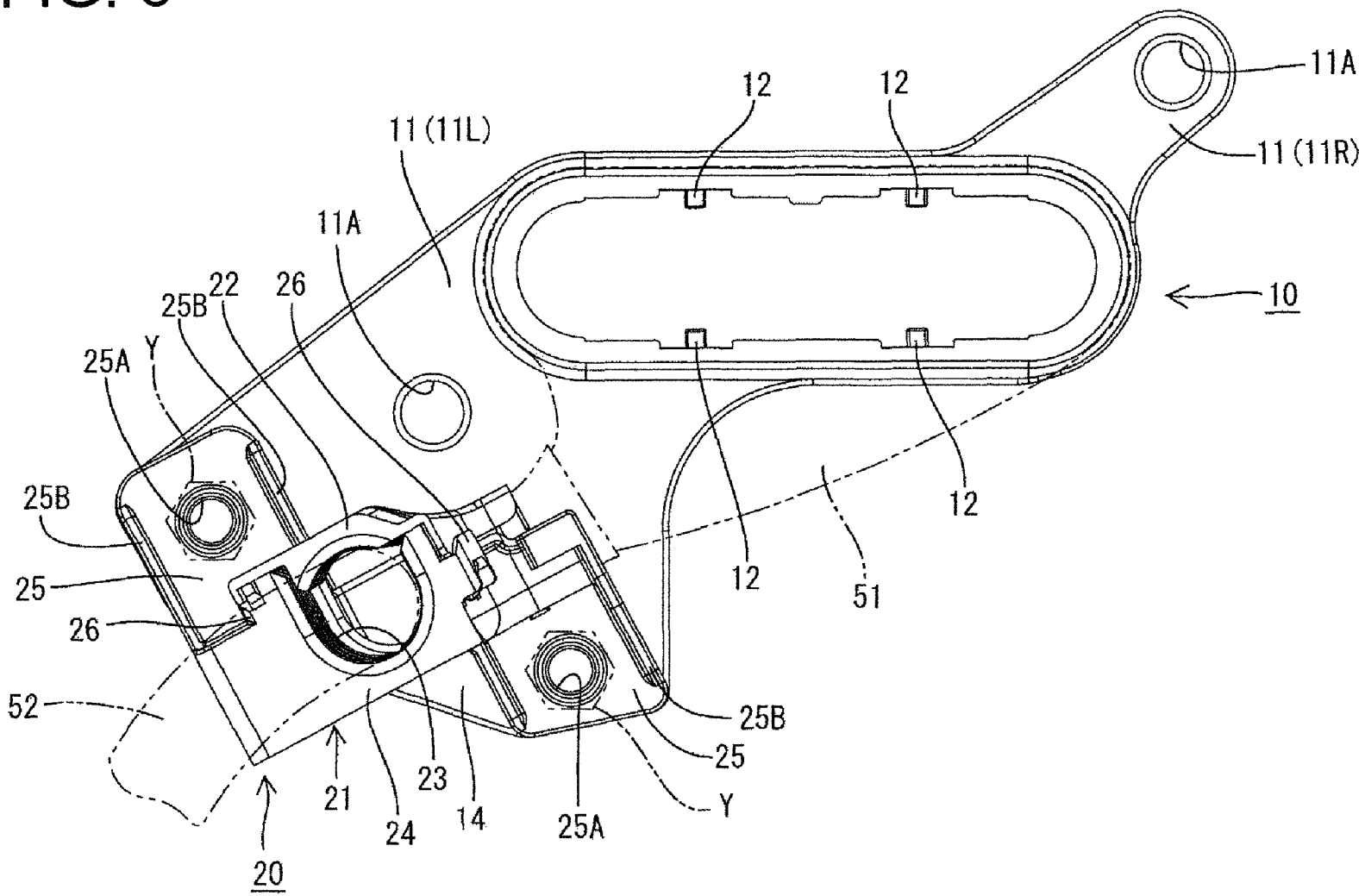
FIG. 6 is a front view showing a state where a braided wire and a corrugate tube are fixed to the wire fixing portion.
Figure 7:
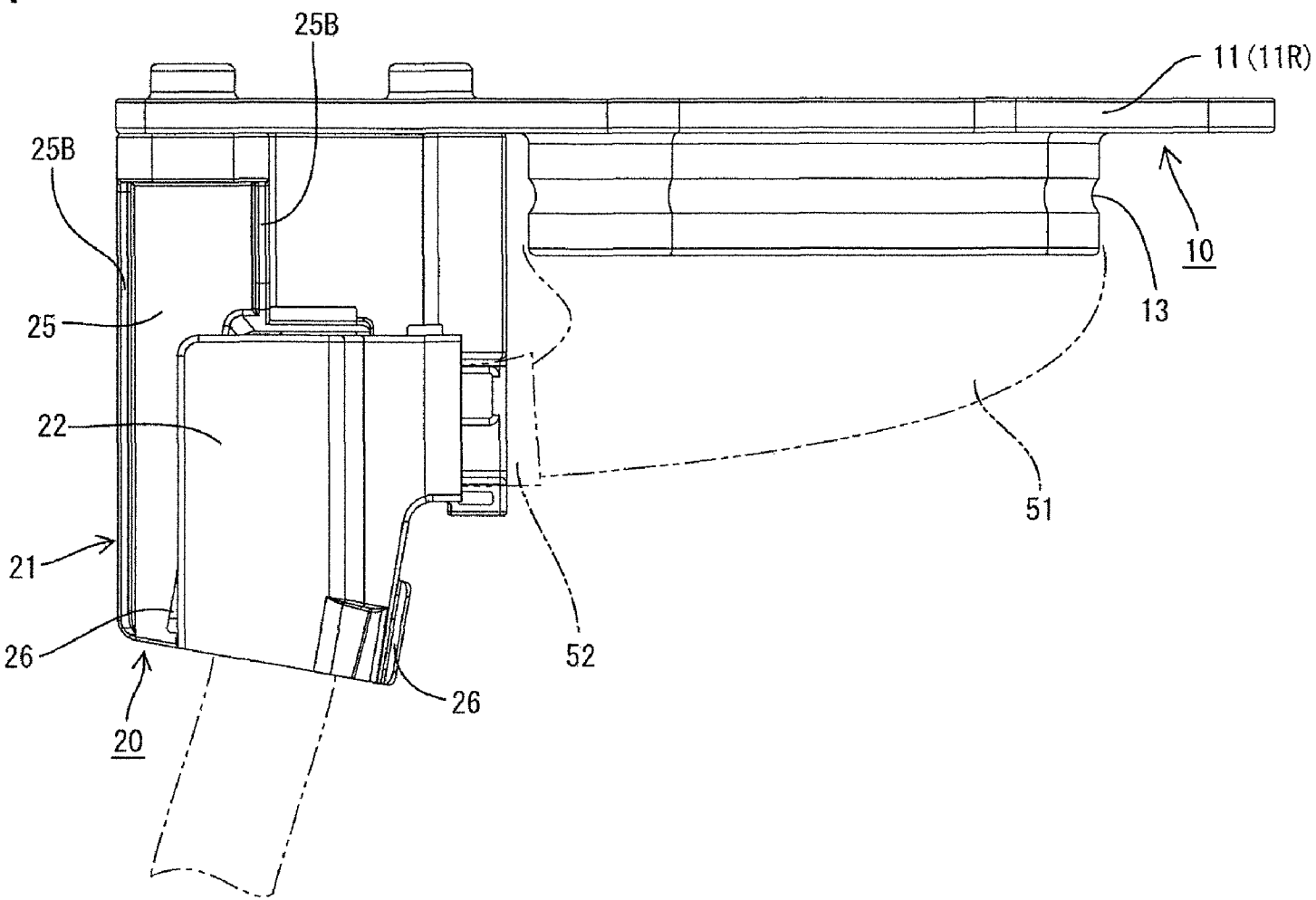
FIG. 7 is a plan view showing the state where the braided wire and the corrugate tube are fixed to the wire fixing portion.
Figure 8:
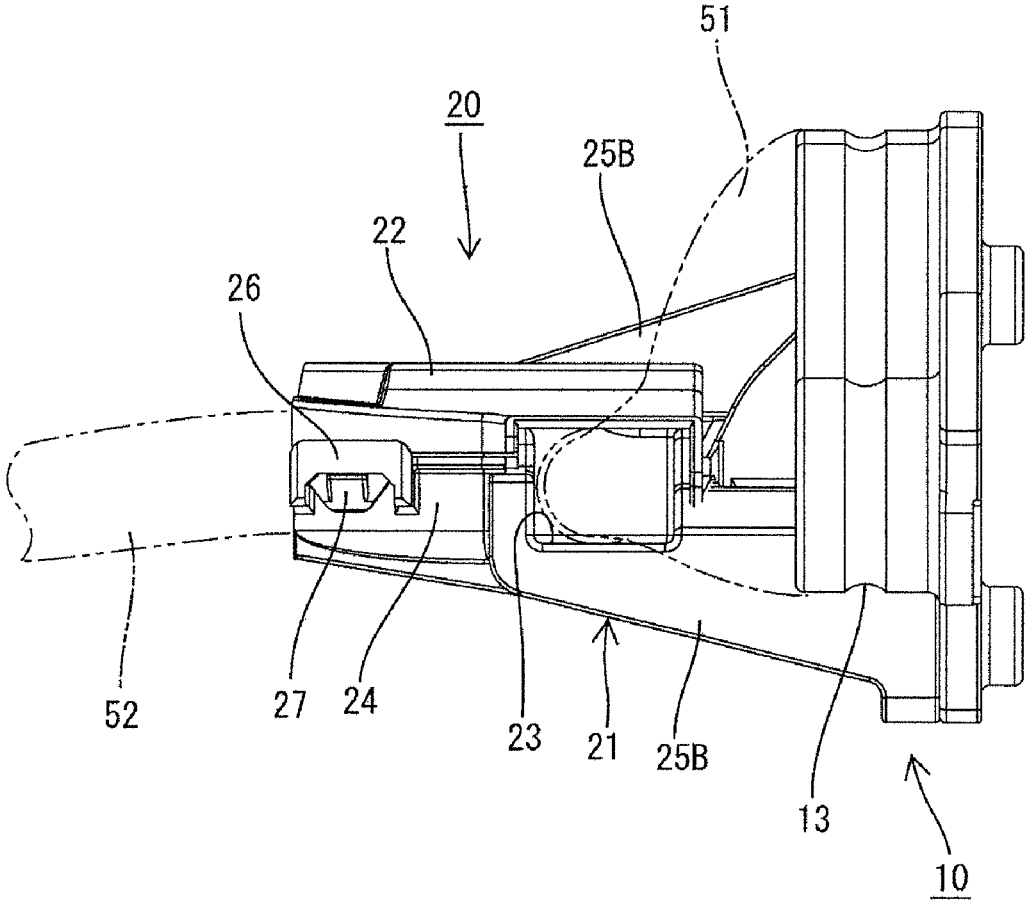
FIG. 8 is a side view showing the state where the braided wire and the corrugate tube are fixed to the wire fixing portion.

A looped mounting groove 13 is formed in the outer surface of the shield shell 10 and can receive a shield layer, such as a braided wire 51 or other shielding member. The wires 50 drawn out from the shield shell 10 can be covered by the braided wire 51 as shown in FIGS. 6 to 8. Thus, the wires 50 drawn out from the shield shell 10 are shielded collectively. Further, a corrugate tube 52 may be mounted outside the braided wire 51. The wires 50, the braided wire 51 and the corrugate tube 52 may be tightened collectively by, for example, a binding band, tightening band, adhesive band or the like so that the wires 50 and the braided wire 51 can be protected and fixed so as not to shake in the corrugate tube 52.

The shield shell 10 and the wire fixing portion 20 are used by bending the wires 50 into an L or S shape and inserting the bent wires 50 along the wire holding groove 23 of the wire receiving portion 21 with the wire pressing portion 22 detached. If necessary, the wires 50 are mounted into the wire holding groove 23 after being covered by the braided wire 51 and/or the corrugate tube 52. The engaging pieces 27 of the wire pressing portion 22 then are inserted into and engaged with the respective engaging frames 26 of the wire receiving portion 21 so that the wires 50 are fixed and sandwiched between the wire receiving portion 21 and the wire pressing portion 22 (see FIGS. 1 to 3). Thus, the wires 50 are fixed to the connector so as not to shake, thereby preventing connected parts between the unillustrated terminal fittings from being abraded due to sliding movements.

Further, the wire holding groove 23 particularly has the L or S shape. Thus, the wires 50 are prevented reliably from shaking forward and backward and the connected parts between the terminal fittings will not abrade due to their sliding movements.

The invention is not limited to the above described and illustrated embodiment. For example, the following embodiments also are included in the scope of the invention.

Although the wire receiving portion 21 made of synthetic resin is fixed to the mounting seat 14 of the mounting piece 11L in the above embodiment, the present invention is not limited to such a mode. For example, the wire receiving portion 21 may be die-cast integral to the shield shell 10.

Although the wire holding groove 23 of the wire receiving portion 21 is bent in L shape in the above embodiment, the invention is not limited to such a mode. For example, the wire holding groove 23 may be straight without being bent.

Although the wire receiving portion and the wire pressing portion are separate parts in the above embodiment, the invention is not limited to such a mode. For example, the wire receiving portion and the wire pressing portion may be coupled by a hinge.

What is claimed is:

1. A vibration prevention structure for use with a device-side connector mounted to a device, the vibration prevention structure comprising:

a conductive shield shell for at least partly covering an outer surface of the connector and to be mounted at an end of at least one wire, the shield shell includes a tubular portion extending in an axial direction and a mounting seat extending from an outer surface of the tubular portion in a direction transverse to the axial direction; and a wire fixing portion bolted to the mounting seat to extend substantially parallel to the axial direction at a position transverse from the tubular portion, a nonlinear wire holding groove formed in the wire receiving portion, the wire holding groove having an entry section aligned angularly to the axial direction and an exit section aligned angularly to the entry section, and a wire pressing portion mounted on the wire fixing portion, the wire pressing portion being configured for fixing the wire drawn out from the connector in the wire holding groove.

2. The vibration prevention structure of claim 1, wherein the wire fixing portion is made of synthetic resin.

3. The vibration prevention structure of claim 2, wherein the wire fixing portion is configured for collectively sandwiching and fixing a shielding member for covering the wire and a protection member for covering the shielding member.

4. The vibration prevention structure of claim of claim 3, wherein the wires, the shielding member and the protection member are fixed integrally by a tightening member.

5. The vibration prevention structure of claim of claim 1, wherein the wire fixing portion is formed with at least one non-linear wire holding groove bent in a direction intersecting a draw-out direction of the wire.

6. The vibration prevention structure of claim 1, wherein the mounting seat is formed with at least one bolt insertion hole for bolting the shield shell to a case of the device.

7. A connector mounted at least partly in an opening a wall of a case of a device, the connector comprising:

a housing mounted at least partly in the case of the device; wires extending from the housing to locations external of the case a conductive shield shell mounted to the wall of the case and having a tubular portion extending in an axial direction and covering at least parts of an outer surface of the housing and the wires, the shield shell further including a mounting seat extending away from the housing in a direction transverse to the axial direction and formed with at least one bolt insertion hole for bolting the shield shell to the wall of the case;

a wire receiving portion bolted to the mounting seat and extending substantially parallel to the axial direction at a position offset from the tubular portion, the wire receiving portion having a non-linear wire holding groove configured for receiving the wires drawn out from the housing, the wire holding groove having an entry section aligned angularly to the axial direction of the tubular portion and an exit section aligned angularly to the entry section; and a wire pressing portion mounted to the wire receiving portion and sandwiching the wires between the wire pressing portion and the wire receiving portion.

8. The connector of claim 7, wherein the wire fixing receiving portion and the wire pressing portion are made of synthetic resin.

9. The connector of claim 2, wherein the wire receiving portion and the wire pressing portion are configured for sandwiching and fixing a shielding member covering the wires and a corrugated tube covering the shielding member.

* * * * *